United States Patent [19]

Cardia

[11] Patent Number: 4,984,718

[45] Date of Patent: Jan. 15, 1991

[54] DISPENSING CONTAINER FOR A VISCOUS FLUID OR SOLIDIFIED STICK-SHAPED PRODUCT, PARTICULARLY FOR COSMETICS

[76] Inventor: Ennio Cardia, 18 Via Durazzo, I-00195 Roma RM, Italy

[21] Appl. No.: 321,819

[22] Filed: Mar. 10, 1989

[30] Foreign Application Priority Data

Mar. 11, 1988 [IT] Italy ..... 47711 A/88

[51] Int. Cl.[5] ..... B67D 5/42

[52] U.S. Cl. ..... 222/390; 222/391; 401/68; 401/74; 401/84; 401/173; 401/175

[58] Field of Search ..... 222/390, 391; 401/68, 401/74, 82–84, 116, 149, 150, 171–175

[56] References Cited

U.S. PATENT DOCUMENTS

| | | | |
|---|---|---|---|
| 2,485,467 | 10/1949 | Weisbaum | 222/390 |
| 2,816,309 | 12/1957 | Worth et al. | 222/390 X |
| 2,823,796 | 2/1958 | Schwartz et al. . | |
| 2,917,765 | 12/1959 | Jakubowski . | |
| 3,333,740 | 8/1967 | Waller | 222/390 X |
| 3,616,970 | 11/1971 | Baumann et al. | 222/390 X |
| 4,139,127 | 2/1979 | Gentile | 222/390 |
| 4,232,977 | 11/1980 | Chutter | 401/172 X |
| 4,363,560 | 12/1982 | Gentile . | |
| 4,521,127 | 6/1985 | Tomburo et al. | 401/171 X |
| 4,664,547 | 5/1987 | Rosenwinkel | 401/172 |
| 4,702,399 | 10/1987 | Davis | 222/390 |
| 4,850,516 | 7/1989 | Seager | 222/390 |

FOREIGN PATENT DOCUMENTS

| | | | |
|---|---|---|---|
| 3118893 | 11/1982 | Fed. Rep. of Germany . | |
| 921860 | 5/1947 | France . | |
| 2556941 | 6/1985 | France . | |
| 863995 | 3/1961 | United Kingdom . | |
| 2064012 | 6/1981 | United Kingdom | 222/390 |

*Primary Examiner*—Joseph E. Valenza
*Assistant Examiner*—Boris Milef
*Attorney, Agent, or Firm*—Browdy and Neimark

[57] ABSTRACT

A container for products, particularly cosmetic or pharmaceutical products, in the form of cream or stick, which dispenses the product in a disposable manner, by rotating the upper portion of the container with respect to the lower portion, having an outer body, an inner body, and having a seal provided for the preservation of the product is shown and described. The container includes a rod which extends along the central axis, the rod having an integral lower wall which has an annular skirt which engages an annular projection on the bottom of the outer body. The inner body has a integral partition wall extending radially (transverse to said axis) and having elastic tabs which slide on a toothed configuration fixed with respect to the outer body.

2 Claims, 5 Drawing Sheets

DISPENSING CONTAINER FOR A VISCOUS FLUID OR SOLIDIFIED STICK-SHAPED PRODUCT, PARTICULARLY FOR COSMETICS

BACKGROUND OF THE INVENTION

1. Field of the Invention

The present invention relates to a container which also serves the purpose of dispensing products, generally of cosmetic or pharmaceutic type, in the form of a solidified stick-shaped material, such as deodorants or lipsticks, or viscous fluid, such as creme, gel, adhesives or the like. The container is of a type comprising a driving member, such as a stick holder or a pressing piston, moved in a rotational and sliding movement by a spiral cam upon a relative rotation of two relatively rotatable bodies of the container.

2. Description of the Prior Art

Containers of this general type are well known in the prior art, representatives of which are containers for lipsticks and stick shaped deodorants.

The containers of the prior art exteriorly show three pieces, a first piece which is the base of the container, on the upper portion of which a cap is inserted forming the second piece, and on the lower portion of which a driving knob is rotatably engaged as a third piece. Upon rotating the knob in one or the other direction with respect to the first base piece, the product is made to project from or retract into the container.

The containers of the prior art thus show on their exterior two coupling planes, one between cap and base and the other between base and knob. Moreover, with the container of the prior art it is possible to turn the knob even with the cap closed, which represents a disadvantage because of the interference between the product and the cap.

It is not conceivable to use a conventional container of this type for fluid products.

By fluid products, products in the form of creme, gel, milk, paste or adhesive and the like are intended.

By solidified stick-shaped products, products, particularly cosmetics, are intended which are poured in a fluid form into the container and there solidified. Typical representatives are lipsticks.

These products frequently also contain ingredients of volatile nature. This raises problems of stability of the product in the container.

The above mentioned conventional containers for stick products comprise a stick holder which is threadedly engaged with a rod integral with the control piece, and sliding within the base piece. To prevent a rotation of the driving piece from rigidly draging the stick holder also into rotation, one or more radial splines are usually provided on the inner surface of the base piece for forcing the stick holder in the axial direction of the container, for its correct rotating and sliding movement.

The presence of splines is frequently detrimental to the external appearance of the product.

In fact it has to be taken into consideration that the problem of the external aspect, particularly in cosmetic products, is of basic commercial importance in this field. Apparently insignificant improvements in this direction could be of a great commercial interest.

Resuming the problems inherent to a container for serving the above indicated purposes, two orders of problems have to be taken into consideration: practical problems and aesthetic problems.

From a practical point of view a conentional container of the above mentioned type cannot conceivably contain a fluid substance and even less can it conserve the volatile ingredients contained in the product. In fact the fluid substance would leak through the coupling gap between driving knob and base piece. This gap is also detrimental to the conservation of volatile ingredients.

Moreover, as hereinbefore illustrated, the driving knob remains accessible at any time, even when the cap is closed, so that an inadvertant rotation of the knob would lead the product to impact against the cap.

A further disadvantage of a practical order is that the control of the knob normally requires the use of both hands, one for holding the base and the other one for turning the knob.

From the aesthetic point of view the conventional containers show the disadvantage that the stick product shows grooves corresponding to the radial splines.

As illustrated hereinbefore, the two coupling planes are decidedly disadvantageous, and moreover the outer and the inner surface of the container do not easily afford any other possibility of shape, apart from the circular cross-section.

In U.S. Pat. No. 4,363,560 a stick container is illustrated. This container, however; does not solve the problems involved in the containment and dispensing of viscous fluid products and of solid products free from unaesthetic grooves.

In FIGS. 5 and 10 of the above cited U.S. Pat. No. it can be seen, in fact, that cartridge 12 is provided with inner ridges 25 to ensure the extracting movement of piston 14. Furthermore, from a structural point of view, rod 13 in the cited patent is correctly mounted integral with the container 11, only when cartridge 12 is assembled in turn into the container. In cited U.S. Pat. No. 4,363,560 there is no teaching that rod 13 has to be built integral or made structurally integral with container 11 in order to obtain the advantages of axial and radial sealing according to the present invention.

Furthermore in the cited patent there is no teaching to eliminate ridges 25 and at the same time obtain the extracting movement of the piston and the tight sealing enabling fluid products to be contained.

SUMMARY OF THE INVENTION

The present invention solves the above illustrated problems with a container which shows the following advantages.

A first advantage is that the container with the cap on, externally shows only one piece, the other piece operating as a rotation knob being completely within the cap and thus not accessible.

A second advantage is that the container is not linked by the coupling plane between base and knob and consequently it can take any geometrical shape apart from the cylindrical one.

A third advantage of the present invention is that because only one coupling plane is externally present between the base and the cap, only one sealing is necessary with respect to the inner product.

A fourth advantage of the present invention is that it can be handled by one hand only, when its size so permits, in that the operation can be carried out by the thumb and the index finger of one same hand holding the container in the palm.

A fifth advantage is that, by making at least the piece acting as a driving knob out of a transparent material, the inner product can be seen from the outside. Thus its colour can be observed without it being necessary to project the product out, but simply by removing the cap, should this not be transparent.

The above advantages are obtained according to the present invention by a dispensing container for a viscous fluid or solidified stick-shaped product of the type in which the product is supported on a driving member having a rotational and sliding movement in the container, characterized in that it comprises: an outer tubular body having an inner surface of circular cross-section, an open top end and a lower end closed by a closure bottom and a threaded rod extending along the axis of the outer body, to the top thereof; an inner tubular body coaxial to said outer body, having an outer surface in sliding contact with the inner surface of the outer body and an opening at its top end, said inner and outer bodies being further engaged by restraining means which prevent a relative movement thereof in an axial direction and enable a relative rotational movement around their common longitudinal axis and said inner body protruding beyond the top of the outer body; said driving member being movable by rotational and sliding movement along said rod upon a relative rotation of the outer body and the inner body, comprising:

said rod integral with said closure bottom or engaged with said closure bottom so as to be integral therewith;

said driving member shaped to apply an elastic pressure to the outer surface of the inner body so that an elastic friction force is produced between said driving member and said inner body which enables an axial movement of said driving member, and fluid-tight axial sealing means between said driving member and said outer surface of the inner body.

BRIEF DESCRIPTION OF THE DRAWINGS

Further features and advantages of the present invention will be better illustrated in the following description of preferred embodiments, with reference to the accompanying drawings, in which.

DETAILED DESCRIPTION OF THE PREFERRED EMBODIMENTS

Figure 1:
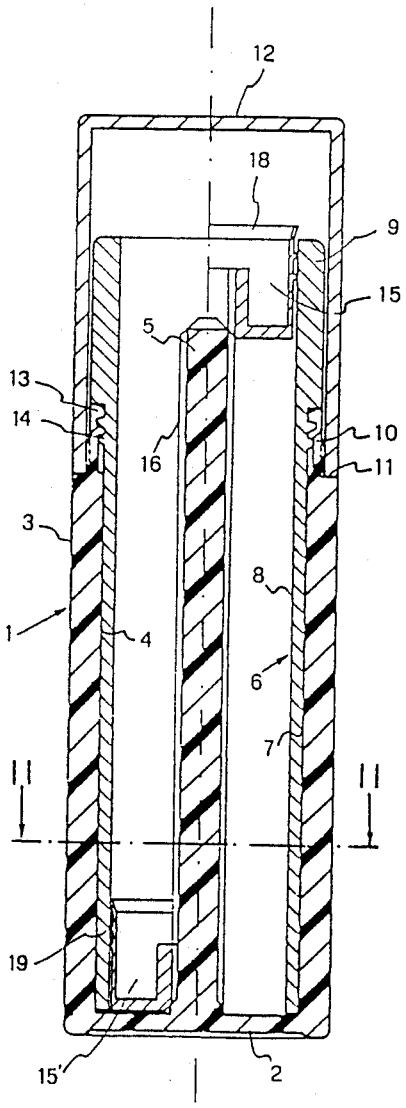
FIG. 1 shows in a longitudinal section, a dispensing container according to the invention, particularly for stick products.
Figure 2:
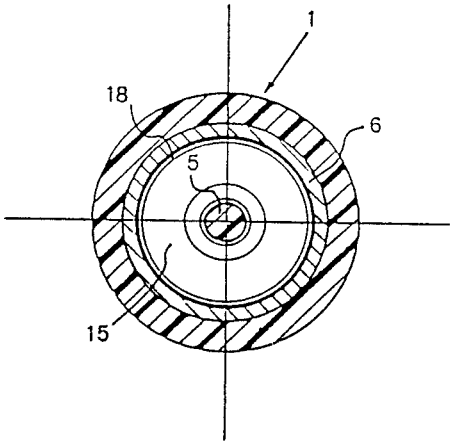
FIG. 2 is a section along the line II—II of FIG. 1.

Referring to FIG. 1, the dispensing container of the present invention is shown in an embodiment fitted to contain solidified fluid products, namely products which are usually denominated "stick", such as deodorants, lipsticks and the like. In a still more particular manner, FIG. 1 is suitable as a container for lip ointment.

The elements of the container of the invention which are common to all the illustrated embodiments, both for solidified and creme-like products, are the following.

An outer tubular body 1 closed at the lower end by a bottom 2 and open at the top end. The outer body 1 further shows an outer surface 3 and an inner surface 4. A feature of the invention is that the inner surface 4 is of circular shape in a cross-section transversal to the longitudinal axis of the outer body 1. Integral with the bottom 2 and extending to the top of the outer body 1 is a rod 5. An inner tubular body 6 is coaxial to the outer body 1 and its outer surface 7 of circular cross-section is in sliding contact with the inner surface 4 of the outer body 1. In 8 the inner surface of the inner body 6 is indicated.

A feature of the present invention is that the inner body 6 protrudes above the outer body 1 by a protruding portion 9.

The outer body 1 and the inner body 6, as hereinbefore illustrated, can rotate one respect to the other upon sliding of the respective inner surface 4 and outer surface 7 around the common longitudinal axis. The two bodies 1 and 6, however, are restrained from a movement in axial direction.

The restraint which prevents the relative axial movement can be realized in different manners.

In FIG. 1 the restraint is realized at the top end of the outer body 1. The outer body 1 at its top has a wall 10 with a reduced thickness with respect to the rest of the wall, the thickness reduction being made both from the inner surface 4 and the outer surface 3 of the outer body 1. In this way on the reduced wall 10 a shoulder 11 is formed, on which a cap 12 is able to rest, as will be further illustrated hereinafter. The wall 10 of body 1 is provided with one or more annular ridges 13 projecting inwards, between which seats are formed, in which similar annular ridges 14, projecting outwards, of the inner body 6 are engaged. This engagement, which upon mounting the container is made by snap, locks the two bodies 1 and 6 with respect to an axial shift thereof, while allowing a relative rotation.

A driving member 15 movable by rotational and sliding motion, is shown in the extreme top position (15) and in the extreme retracted bottom position (15'). The driving member, in the case of the embodiment of FIG. 1 consisting of a stick holder, serves the purpose of supporting the product and pushing it upwards for utilization. In the case of solidified stick-shaped products, the driving member is shaped like a holder, whereas in the case of creme products it will be shaped like a pressing piston. In the following description, the terms "holder" and "piston" will be used as synonims of "driving member" depending on the particular case.

Figure 3:
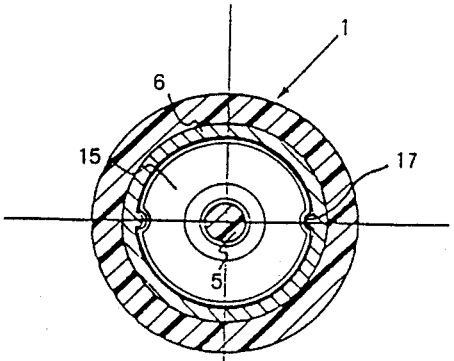
PRIOR ART Fig. 3
FIG. 3 is an embodiment according to the prior art.

In the embodiment illustrated in FIG. 1, the holder 15 is threadedly engaged with the rod 5 of the outer body 1. In 16 the thread on the rod 5 is indicated. In the prior art, to ease the translation in the direction of the longitudinal axis of the holder 15, the inner surface 8 of the inner body 6 was provided with one or more longitudinal splines 17 (see FIG. 3).

However, according to the present invention, the inner surface 8 of the inner body 6 is made with no such splines 17 and shifting in axial direction of the holder 15 is obtained by means of a configuration of the holder 15 which produces an elastic friction force between the holder 15 and the inner surface 8. This friction force is produced by means of a flare of the upper edge of the holde scraping the inner surface 8 and annular beads 19 projecting outwards from the holder to maintain alignment under the elastic friction with the inner surface 8. In such a way the stick product emerging from the inner body 6 is free from the antiaesthetic prints of the splines 17.

In FIG. 1 and in the embodiments hereinafter illustrated, the driving member 15 is threadedly engaged with the rod 5 integral with the outer body 1. However, it can be understood that in a mechanically equivalent way, the driving member 15 can be threadedly engaged with the inner surface 8 of the inner body 6 and axial sliding along the rod 5. Resorting to one or the other manner of engagement, will depend on practical factors linked to problems regarding moulding of the pieces.

The last element of the container is the cap 12. The cap 12 is in contact with the outer body 1 on the shoulder 11 and on the outer part of the reduced wall 10, whereas on the contrary it is not in contact with the protruding portion 9 of the inner body 6.

Considering the above illustrated structure, it will be first noted that with the cap 12 applied, only the line of the shoulder 11 will be externally visible. This enables the outer surface 3 of the outer body 1 and the cap 12 to be given any cross-sectional configuration of their outer surface, in contrast with the containers of the prior art.

The control of the rotational and sliding motion of the holder 15 is made by rotating the inner body 6 with respect to the outer body 1 or vice versa. The rotation takes place along the contact between the inner surface 4 of the body 1 and the outer surface 7 of body 6. As a consequence, the inner surface 8 of the inner body 6 in the embodiment with a threaded rod 5, can take any cross-sectional configuration, with the result that the cross-section of the stick can be made as one likes. In the case instead of the threaded engagement of the driving member 15 taking place on the inner surface 8 of the inner body 6, preferably not for stick products, but for creme products, it is the cross-section of the rod 5 which can be made in any configuration.

The structure illustrated in FIG. 1 is common to all the embodiments which will be described hereinafter, and it shows, moreover, the advantage that upon making the inner body 6 of transparent material, it is possible, without touching or projecting out the product, simply to observe it by taking off the cap, when this is not transparent also. This is an important feature, enabling a choice of the colour of the product, particularly in the case of lipsticks.

Within the scope of the general structure of the dispensing container according to the invention, a plurality of useful modifications are possible which make the invention of great adaptability to various requirements, particularly felt in the cosmetic field. A plurality of modifications will be illustrated hereinafter to show the versatility of the present invention.

Generally, to make an example, the outer body 1 and the inner body 6 can be made in several pieces when this is necessary for moulding requirements or for reasons of compatibility of the various plastic materials with the product to be contained.

Moreover, the restraint which prevents the relative axial movement of the inner and the outer bodies can be realized either at the top, as shown on FIG. 1, or in correspondence with the bottom end, as it will be illustrated in modified embodiments.

The problem of the sealing, moreover, is very important when the content is of a fluid nature, or it contains volatile ingredients, the evaporation of which has to be prevented.

In the various embodiments which are illustrated hereinafter, as far as possible, the same reference numerals as those of FIG. 1 are used for indicating similar elements and to avoid prolixity of description.

Figure 4:
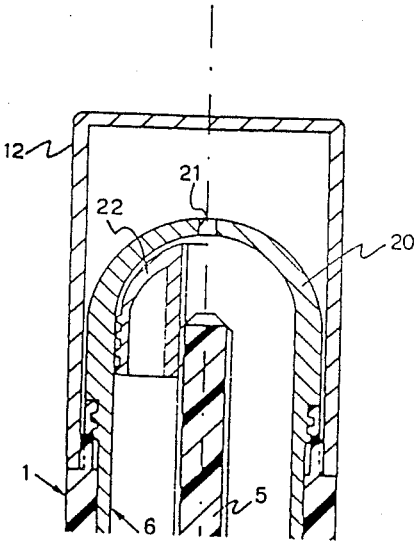
FIG. 4 is an embodiment of the invention fitted to creme-like products.

In FIG. 4 an embodiment is shown adapted to a creme product to be dispensed through a bore. In FIG. 4 the inner body 6 is extended to the top forming a closure wall 20 in which a hole 21 is provided. The driving member is in the form of a piston head 22 shaped to be complementary to the closure wall 20. The other features of the container of FIG. 4 can be similar to those of FIG. 1.

Figure 5:
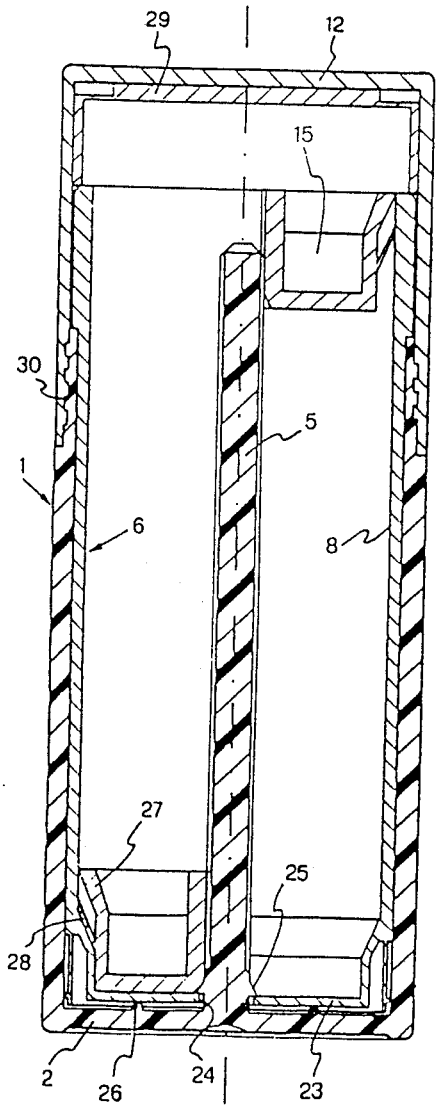
FIG. 5 is a container of the invention provided with an embodiment of sealing means.

FIG. 5 shows a container according to the invention in which a hermetic sealing is particularly designed, in which the restraint between outer body 1 and inner body 6 is made at the bottom, rather than the top.

In the embodiment of FIG. 5, the inner body 6 is provided on its lower part with a bottom wall 23 having a central bore 24. The rod 5 of the outer body 1 has a radially extending ridge 25 near the bottom 2. The same bottom 2 has a circular rib 26 for supporting the bottom wall 23 of the inner body 6. The inner body 6 is mounted into the outer body 1 by inserting the rod 5 into the bore 24 until the ridge 25 snaps above the bore 24, thus locking the inner body. The holder 15 is made with a wide flaring 27, which serves the double purpose of producing friction by elastic action against the inner body 6 and obtaining a sealing relationship between the same flaring 27 and the inner surface 8 of the inner body 6. The holder 15 can also be provided with an additional flange 28, which is also flared towards the inner surface 8 of the inner body 6 to insure a better axial sealing and to overcome possible defects of the flaring 27 due to moulding inaccuracies.

Moreover, to ensure a sealing relationship between the inside and the outside, a capsule 29 generically integral with the cap 12, in a sealing engagement with the top rim of the inner body 6, and a screw engagement 30 of the cap 12 and the outer body 1, can be provided.

It will be observed from the embodiment of FIG. 5 that making the outer body 1 with a bottom integral therewith, makes it possible to solve sealing problems which otherwise would be of difficult solution with dispensing containers of the prior art.

Figure 6:
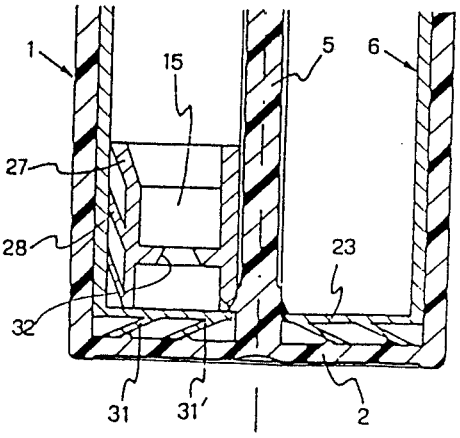
FIG. 6 is a modification of the container of FIG. 5.

In FIG. 6 a further modification of FIG. 5 is illustrated, in which the inner body 6 is provided with flanges 31, 31' integral with the bottom wall 23, and moreover the holder 15, in addition to flarings 27 and 28 similar to those shown in FIG. 5, has bottom openings 32. The modification of FIG. 6 provides a safer engagement of the solidified fluid product, when this is poured from the top into the inner body 6, in that it can get a better grip passing through the openings 32.

Figure 7:
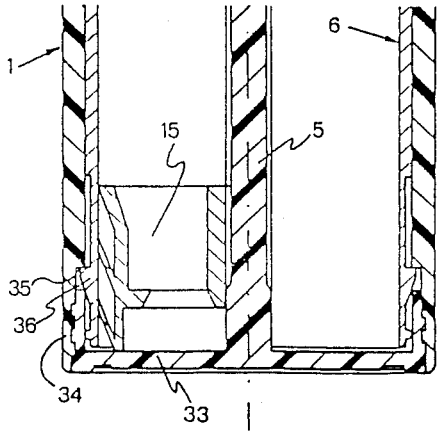
FIG. 7 shows a modification of the coupling between the inner and outer bodies.

FIG. 7 shows a further modification in the realization of the constraint between outer body 1 and inner body 6 to prevent their relative axial movement. In FIG. 7, which represents a type of container which can be used in the same way as that of FIG. 6, the bottom 33 of the outer body 1 is made as a separate piece which is rigidly secured to the body 1 by screwing or press fitting or alternatively by force fitting, snap fitting, glueing, as by ultrasonic waves. The outer body 1 is thus provided with a wall 34 of reduced thickness at the bottom extremity, so that a shoulder 35 is formed. The inner body 6 is open at the bottom and has an annular rib 36 locked on the shoulder 35 when the inner body 6 is inserted into the body 1 from the top.

The embodiment in FIG. 7 is a structure also enabling the fluid stick product to be poured into the bottom end of the outer body 1, rather than only into the top end, as in the preceding embodiments. Again in this embodiment, however, once the bottom 33 has been made integral with the outer body 1, a dispensing container is obtained having the same features as hereinbefore described.

Figure 8:
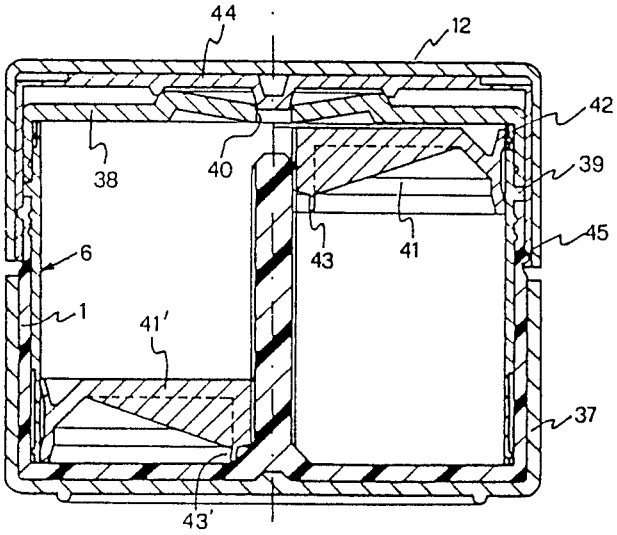
FIG. 8 is an embodiment of the invention for creme-like products with particular features relating to the realization of the sealing and the structure of the container.
Figure 9:
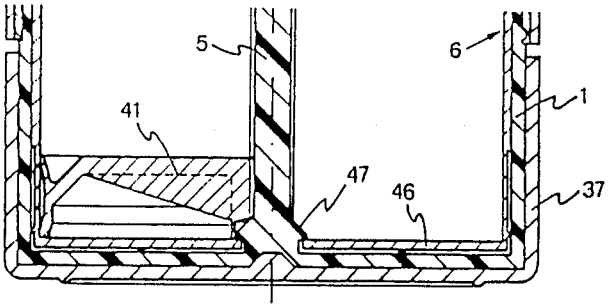
FIG. 9 is a modification of FIG. 8.
Figure 10:
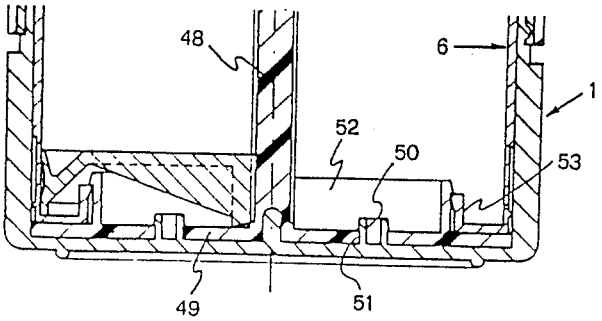
FIG. 10 is a further modification.

FIG. 8, 9 and 10 show an embodiment of the container according to the invention, particularly useful for viscous fluid products, such as creme, gel, milk, paste and the like.

Whereas apparently the container structures shown in FIGS. 8 to 10 are more complicated than the containers shown in the preceding figures, the essential characteristics recited for a dispensing container of the present invention remain unchanged. Starting from FIG. 8, the outer body 1 and the inner body 6 are coupled at the top end of body 1, substantially in the same manner as illustrated in FIG. 1. However, the outer body 1 has an outer cladding 37. The use of the cladding 37 can be necessary mainly for aesthetic reasons, when compatibility is a problem due to the contact between the contained product and the outer body 1. In fact, problems of compatibility may have the consequence that the material of the outer body 1 is not satisfactory for aesthetic or mechanical strength requirements, so that an outer cladding 37, which can be made of a material selected in a way independent on the content of the container, can afford a solution to this problem.

The inner body 6 is closed at the top by a closure wall 38 integral with an annular ridge 39 on the inner body 6. The closure wall 38 has a dispensing bore 40 at its centre.

The driving member indicated with 41 in the extreme top position and 41' in the retracted bottom position, is a substantially flat piston with a lip configuration 42 having the purpose of producing an axial hermetic seal against the inner surface of the inner body 6, as well as being a friction elastic element for carrying out the rotating and sliding driving action of the piston 41. The lower portion of piston 41 has a skirt 43 for a radial sealing relationship with the bottom of the outer body 1 or with an annular bead at the foot of the rod 5, when the container is stored with the product and the sealing requirements are of considerable importance.

The cap 12 of the container shown in FIG. 8 contains an inner capsule element 44 integral therewith in sealing relationship with the dispensing bore 40 and the closure wall 38 when the cap is screwed on the outer body 1 by means of a thread 45.

It can be understood that the embodiment shown in FIG. 8 is particularly suitable to contain a creme substance, which is dispensed by removing the cap 12 together with the capsule 44 and rotating the inner body 6 through the closure wall 38 with respect to the outer body 1, so as to make the piston 41 rise and some creme be dispensed out of the bore 40. It can also be noted that the creme is collected above the closure wall 38, thus avoiding any contact of the fingers with the product within the container. This prevents pollution and degradation of the product.

FIG. 9 is a modification of FIG. 8, in which the restraining engagement of the inner body 6 and the outer body 1 is realized at the lower end by means of a bottom wall 46 integral with the inner body 6 and an annular bead 47 integral with the rod 5, substantially in the same manner as illustrated in the embodiment of FIG. 5.

FIG. 10 shows a further modification of the structure of FIG. 8. In FIG. 10 the threaded rod 48 is integral with a disc 49. The disc 49 in turn is integral with the outer body 1 by means of engagement of bosses 50 of the outer body 1 into bores 51 of the disc 49. In this arrangement the rod and the outer body, while being integral, can be made of different materials. The engagement of the disc 49 and the outer body, in addition to the undercut bosses 50 and bores 51, could also be obtained by glueing the disc 49 on the bottom of outer body 1, as by ultrasonic waves.

The engagement of the outer body 1 and the inner body 6 can be obtained, as shown in FIG. 10, by means of a continuous or discontinuous crown 52 integral with the disc 49, having undercut beads projecting outwards, and a crown 53 integral with the inner body 6 with such a configuration as to enable the engagement of the undercut beads on crown 52 with an annular rib on the crown 53.

Figure 11:
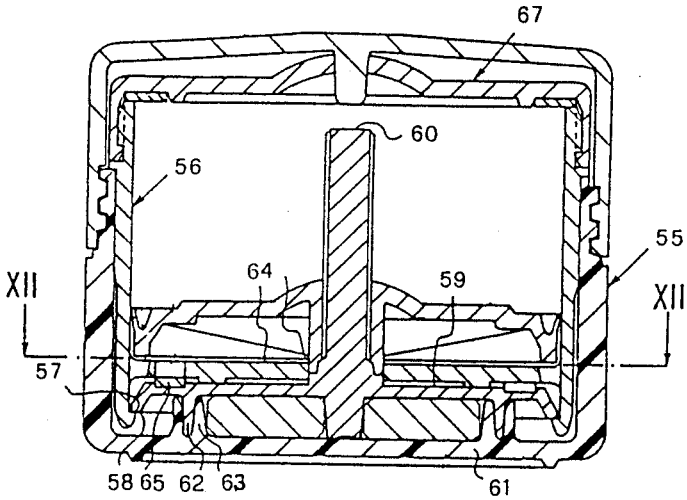
FIGS. 11 to 15 are further embodiments of the invention.
Figure 12:
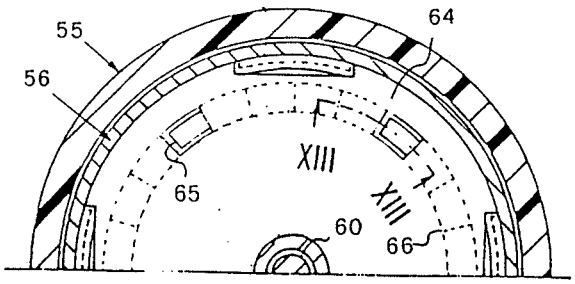
Figure 13:
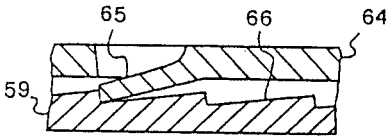

A further embodiment is shown in FIGS. 11 to 13.

The restraint to a relative axial movement of the outer body 55 and the inner body 56 is realized at the lower part by means of an annular projection 57 at the lower end of inner body 56 and a flange 58 integral with rod 60, as shown in FIG. 11.

Rod 60 is made integral with the bottom 61 of outer body 55 by forced friction engagement of an annular skirt 62 pending on a lower wall 59 integral with the rod 60 and an annular slot in an annulat projection 63 on the bottom 61 of the outer body 55.

In the embodiment of FIG. 11, in order to prevent an undesired relative backwards movement of the outer body 55 and the inner body 56, the inner body 56 is provided with a partition wall 64 overlaid above the lower wall 59 of rod 60. On the partition wall 64 a configuration is provided of elastic tabs 65, which slide on a toothed configuration 66 provided on the lower wall 55 of rod 60. The engagement of the tabs 65 and teeth 66 enables a circular relative movement in one direction and prevents a relative movement in the opposite direction.

The embodiment of the container in FIG. 11 is directed to a viscous fluid product, such as cream, gel and the like, and it is provided at its upper part with a cover wall 67 having a hole for the output of the product.

Figure 14:
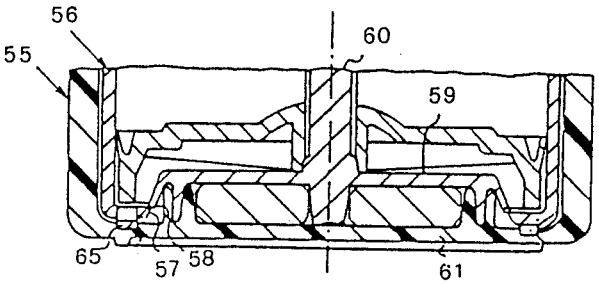
Figure 15:
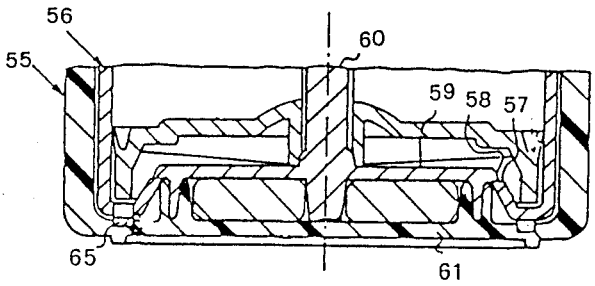

FIGS. 14 and 15 show two further modifications of the embodiment of FIG. 11, in which elements similar to those shown on FIG. 11 are indicated with the same reference numerals.

What is claimed is:

1. Dispensing container for a viscous fluid, of the type in which the fluid is supported on a driving member having a rotational and sliding movement in the container, including an outer tubular body (55) having an inner surface of circular cross-section, an open top end and a lower end closed by a closure bottom (61), and a threaded rod (60) coaxial to the outer body, an inner tubular body (56) coaxial to said outer body, having an outer surface in sliding contact with the inner surface of the outer body and an opening at its top end, said inner and outer bodies being further engaged by restraining means which prevent relative movement thereof in an axial direction and enable a relative rotational movement around their common longitudinal axis and said inner body protruding beyond the top of the outer body; said driving member being movable by rotational and sliding movement along said rod upon a relative rotation of the outer body and the inner body, said rod being engaged with said closure bottom so as to be integral therewith, and said driving member being threadedly engaged with said rod and shaped to apply an elastic pressure to the inner surface of the inner body to produce an elastic friction force between said driving member and said inner body which enables an axial movement of said driving member and having means producing a fluid-tight axial sealing between said driving member and said inner surface of the inner body, a lower wall (59) integral with said rod (60), provided with an annular skirt (62) and said closure bottom (61) of the outer body (55) has an annular skirt (63) for an assembly in an integral manner of the rod to said closure bottom, said restraining means which prevent a relative axial movement of the outer (55) and the inner body (56) comprise a peripheral flange (58) on said lower wall (59) integral with the rod and an annular ridge (57) at a lower end of the inner body (56) and;

said inner body (56) further comprising an integral partition wall (64) extending transversely to said longitudinal axis having elastic tabs (65) concentrically arranged around the rod, which are able to slide on a toothed configuration fixed with respect to said outer body to prevent an undesired relative backwards movement of the rod and the inner body;

said partition wall being placed between said lower wall (59) and said top end of the inner body, and said toothed configuration (66) being provided on said lower wall (59).

2. A container as claimed in claim 1, in which the top end of the inner body is closed by a top wall provided with an outlet bore for dispensing the fluid through said bore under the pressure of said driving member.

* * * * *